US005765093A

United States Patent [19]

Funato

[11] Patent Number: 5,765,093

[45] Date of Patent: Jun. 9, 1998

[54] IMAGE RECORDING APPARATUS WITH RECORDING MEDIUM BENDING

[75] Inventor: Hitoshi Funato, Ebina, Japan

[73] Assignee: Fuji Xerox Co., Ltd., Tokyo, Japan

[21] Appl. No.: 589,370

[22] Filed: Jan. 22, 1996

[30] Foreign Application Priority Data

Jan. 23, 1995 [JP] Japan ..... 7-008491

[51] Int. Cl.[6] ..... G03G 15/00

[52] U.S. Cl. ..... 399/406; 271/265.04; 399/45; 399/389

[58] Field of Search ..... 355/271, 274, 355/208, 311, 317, 308, 309; 271/265.04, 262, 263, 273; 399/389, 391, 318, 313, 316, 66, 297, 406, 45

[56] References Cited

U.S. PATENT DOCUMENTS

| | | | |
|---|---|---|---|
| 4,985,736 | 1/1991 | Kawano et al. | 355/311 |
| 5,384,630 | 1/1995 | Nakamura et al. | 355/271 X |
| 5,455,664 | 10/1995 | Ito et al. | 355/208 X |
| 5,504,565 | 4/1996 | Tomiki et al. | 355/274 |
| 5,565,970 | 10/1996 | Suda | 355/308 |

FOREIGN PATENT DOCUMENTS

| | | |
|---|---|---|
| A-59-108641 | 6/1984 | Japan . |
| A-62-264159 | 11/1987 | Japan . |
| A-4-245273 | 9/1992 | Japan . |
| A-4-305674 | 10/1992 | Japan . |
| 5-221551 | 8/1993 | Japan . |
| 6-92529 | 4/1994 | Japan . |
| 6-167895 | 6/1994 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

An image recording apparatus includes a paper bending assembly for bending an image recording medium in accordance with the supporting surface of an image transferring drum. A degree of the bending of the image recording medium is set in accordance with the kind of image recording medium by varying the distance between the shafts of the paper bending assembly.

12 Claims, 9 Drawing Sheets

WHEN THE THICK PAPER MODE OR THE ENVELOPE MODE ENDS

FIG.8A

| | |
|---|---|
| OUTER DIAMETER 23mm, SHAFT 12mm, CENTER REGI RUNNING | ○——○ |
| OUTER DIAMETER 23mm, SHAFT 12mm, SIDE REGI RUNNING | ●——● |
| OUTER DIAMETER 26mm, SHAFT 12mm, CENTER REGI RUNNING | □——□ |
| OUTER DIAMETER 26mm, SHAFT 12mm, SIDE REGI RUNNING | ■——■ |
| OUTER DIAMETER 23mm, SHAFT 10mm, CENTER REGI RUNNING | △——△ |
| OUTER DIAMETER 23mm, SHAFT 10mm, SIDE REGI RUNNING | ▲——▲ |

FIG.9A

| | |
|---|---|
| OUTER DIAMETER 23mm, SHAFT 12mm, CENTER REGI RUNNING | ○——○ |
| OUTER DIAMETER 23mm, SHAFT 12mm, SIDE REGI RUNNING | ○——○ |
| OUTER DIAMETER 26mm, SHAFT 12mm, CENTER REGI RUNNING | □——□ |
| OUTER DIAMETER 26mm, SHAFT 12mm, SIDE REGI RUNNING | □——□ |
| OUTER DIAMETER 23mm, SHAFT 10mm, CENTER REGI RUNNING | △——△ |
| OUTER DIAMETER 23mm, SHAFT 10mm, SIDE REGI RUNNING | △——△ |

IMAGE RECORDING APPARATUS WITH RECORDING MEDIUM BENDING

BACKGROUND OF THE INVENTION

The present invention relates to an image recording apparatus using an image transferring system in which an image is transferred onto an image recording medium, which is supported on an image transferring drum.

More particularly, the invention relates to an image recording apparatus in which any kind of image recording medium is securely supported on the image transferring drum, and a bending of normal paper, which is frequently used as an image recording medium, is not caused.

There is known an image recording apparatus, such as a copying machine, in which a print sheet is supported on an image transferring drum, and a toner image is printed from the photoreceptor drum onto the print sheet being supported on the image transferring drum. In this type of image recording apparatus, it is necessary to exactly place the print sheet on the transferring drum in order to prevent an irregular transferring of image and mis-registration of colors.

Recently, many copying machines are capable of printing images on image recording media other than normal paper. Examples of those recording media are post or postal cards and envelopes, and image recording media other than those of the regular form, such as thick papers. When a relatively thick paper is used for the image recording medium, it is difficult to bring the thick paper into close contact with the transferring drum since the paper is rigid and the transferring drum has a curvature. Particularly, where the thick paper is supported on the transferring drum by electrostatic force, an unstable support of the paper on the transferring drum occurs frequently. Where the paper support on the drum is unstable, the transferring of the images is irregular and not uniform, and the colors are out of register.

To solve the problem, a unique image recording apparatus is proposed in Japanese Patent Laid-Open Publication No. Hei. 4-305674.

In the image recording apparatus, a curling means is located at the prestage of a medium supplying means for supplying an image recording medium. The curling means includes an opening through which an image recording medium is inserted into and taken out of the curling means, an insertion guide, located subsequent to the opening, consisting of a horizontal path which does not bend the image recording medium, and a bending guide, located subsequent to the insertion guide, consisting of a curved path for curling the end part of the image recording medium in the same direction as the curving direction of the outer surface of the image transferring drum. Since the image recording apparatus is thus constructed, the trailing end part of the image recording medium is curled in the same direction as of the curve of the outer surface of the image transferring drum, before the image recording medium is supplied from the medium supplying means. Therefore, the unstable attraction of the image recording medium onto the image transferring drum is secured, so that the image recording medium is securely put on the image transferring drum.

Another image recording apparatus is disclosed in Japanese Patent Laid-Open Publication No. Sho. 59-108641. In the apparatus, before the image recording medium is supplied to the image transferring part of the image transferring drum, an image recording medium is nipped with the pair of a drive roller and a follower roller made of elastic material, to thereby remove its curl from the image recording medium. Our study on this curl removal means showed that it could be used as the means for curling the image recording medium. Accordingly, there is the possibility that the curl removal means is applicable to wind the image recording medium around the image transferring drum.

In the image recording apparatus of Japanese Patent Laid-Open Publication No. Hei. 4-305674, any kind of image recording medium is curled in the same degree. Therefore, if the image recording medium is excessively bent, an inexact transportation of the image recording medium is secured. The result is the deterioration of the image alignment performance, and an excessive bending of the image recording medium with an image recorded thereon, which leads to degradation of the paper quality. If a degree of the bending of the recording medium is insufficient, the transferring of the image onto the image recording medium is irregular and not uniform as already referred to.

In the image recording apparatus of Japanese Patent Laid-Open Publication No. Sho. 59-108641, the normal paper that creates no problem if it is not bent, is also bent. The result is to deteriorate the quality of the normal paper, which is most frequently used.

SUMMARY OF THE INVENTION

Accordingly, an object of the present invention is to provide an image recording apparatus in which an image recording medium of any kind is securely supported on the image transferring drum..

Another object of the present invention is to provide an image recording apparatus in which bending of normal paper, which is most frequently used, is not caused.

In order to securely supporting any kind of image recording medium on an image transferring drum, and not to cause bending of normal paper, which is most frequently used, there is provided an image recording apparatus comprising: a medium transporting path for transporting the image recording medium onto the image transferring drum; medium bending means, provided in the medium transporting path, for bending the image recording medium along the curved supporting surface of the image transferring drum; bending condition setting means for setting the conditions for bending the image recording medium by the medium bending means on the basis of the kind of image recording medium; timed medium-supplying means for supplying the image recording medium to the image transferring drum at the time of transferring a toner image onto the image recording medium; and time/condition setting means for setting the time of supplying the image recording medium to the image transferring drum by the timed mediumsupplying means on the basis of the kind of image recording medium or the conditions for bending the image recording medium set by the bending condition setting means.

The image recording apparatus is preferably constructed such that the medium bending means includes a rigid roll that may be turned about a first shaft, and a deformable roll that may be turned about a second shaft, when the outer surface of the rigid roll is pressed against the outer surface of the deformable roll, the outer surface of the deformable roll being deformable; and the bending condition setting means varies a distance between the first and the second shafts on the basis of the kind of image recording medium.

The time/condition setting means preferably sets the timed medium-supplying means so as to supply the image recording medium to the image transferring drum earlier as the distance between the first and second shafts that is set by the bending condition setting means becomes shorter. This construction solves such a problem that when a degree of the bending of the image recording medium is large, the image recording medium is delayed in arriving at the image transferring drum, so that the recording position is shifted from a preset recording position.

When information indicative of a kind of image recording medium is entered from the medium information input means, the control means sets a value set by the bending-degree setting means to a value that is based on the kind of image recording medium. The medium bending means bends the image recording medium passing through the medium transporting path to such a degree that is set by the bending-degree setting means. Therefore, any kind of image recording medium can be properly bent so that it is securely supported on the image transferring drum.

BRIEF DESCRIPTION OF THE DRAWINGS

FIG. 8A is a description of the graph in FIG. 8.

FIG.9A is a description of the graph in FIG. 9.

DETAILED DESCRIPTION OF THE PREFERRED EMBODIMENTS

The preferred embodiment of an image recording apparatus according to the present invention will be described with reference to the accompanying drawings.

Figure 1:
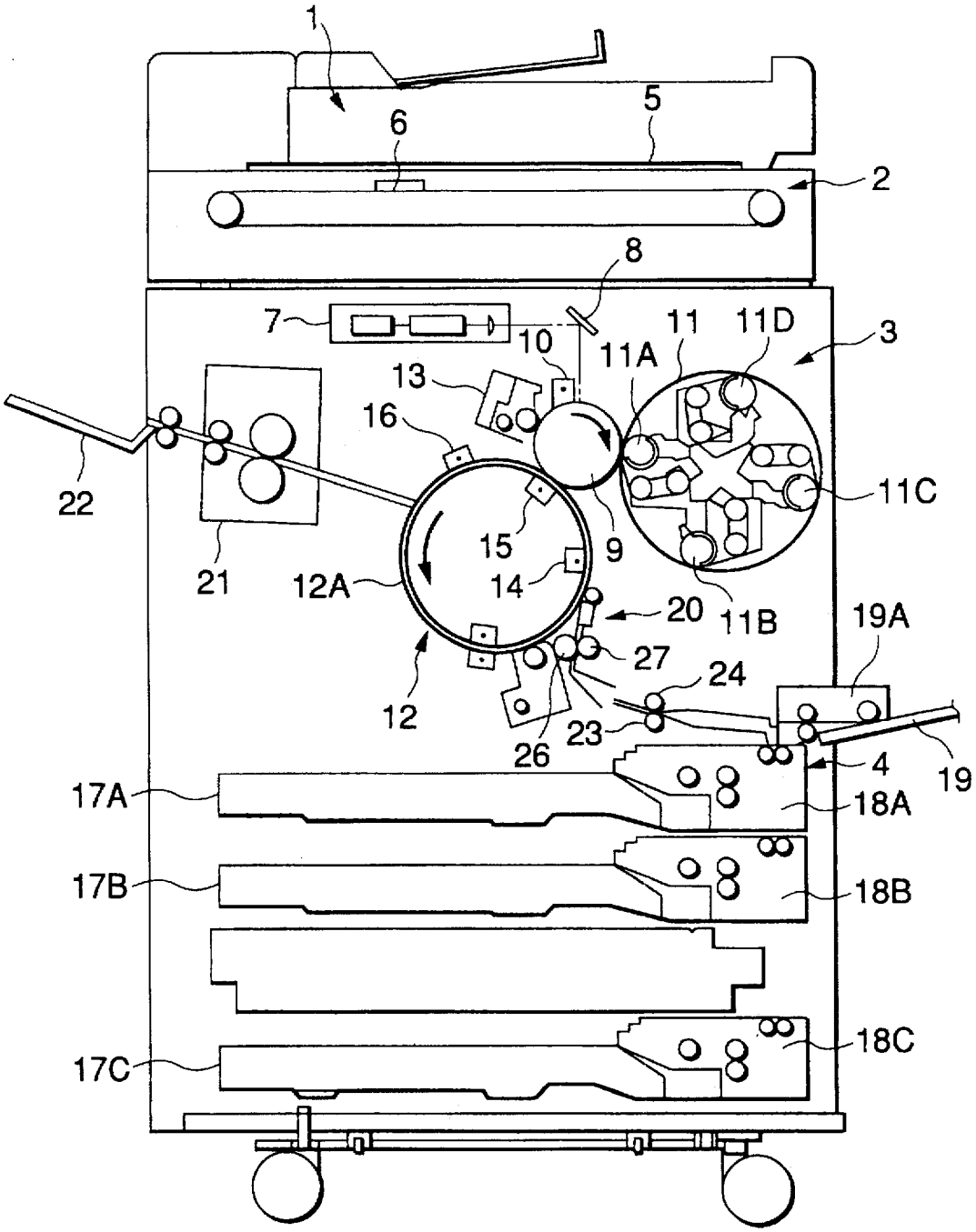
FIG. 1 is a view schematically showing the construction of a color copying machine incorporating the present invention.

FIG. 1 is a view schematically showing the construction of a color copying machine incorporating the present invention. That is, an image recording apparatus of the present invention takes the form of the color copying machine. The color copying machine is generally made up of an automatic document feeder (ADF) 1 for automatically feeding an image recording medium, e.g., a paper, to an image input section 2, the image input section 2 for reading an image on the paper in an optical scan manner, an image recording section 3 for recording the image read out by the image input section 2 onto the paper, and a paper supply section 4 for supplying the paper to the image recording section 3.

The image input section 2 includes a platen 5 on which an original document, supplied from the ADF 1, is located, a lamp 6 for radiating the original document located on the platen 5, a CCD (not shown) which receives reflecting light from the original through an optical system, and the like. The CCD reads the image contained in the reflecting light through the filters of R, G and B.

The image recording section 3 is made up of an writing unit 7, a reflection mirror 8, a photoreceptor drum 9, a charging corotron 10, a developing unit 11, a transfer drum 12, a cleaning unit 13, and a fixing unit 21. The writing unit 7 includes a memory for storing color image data signals of Y (yellow), M (magenta), C (cyan), and BK (black), which are produced through the color separation process in the image input section 2, a laser device as a light source for emitting laser beams modulated by the image data, which is read out of the memory, a rotary mirror with a multiple of facets for deflecting the light beam, and the like. The reflection mirror 8 reflects the light beam from the image writing unit 7 in the scanning direction. The photoreceptor drum 9 receives the light beam from the reflection mirror 8 while being turned clockwise, so that an electrostatic latent image is formed on the surface thereof. The charging corotron 10 charges the surface of the photoreceptor drum 9. The developing unit 11 develops the electrostatic latent image with toner into a toner image. The image transferring drum 12 is rotated by one turn every time each color toner image is formed on the photoreceptor drum 9 while supporting a paper supplied from the paper supply section 4, so that the toner images of the respective colors are transferred from the photoreceptor drum 9 onto the paper at the transfer part thereof. The cleaning unit 13 removes toner left on the photoreceptor drum 9. The fixing unit 21 fixes the toner image on the paper, which is separated from the image transferring drum 12. The paper bearing the fixed image thereon, which emanates from the fixing unit 21, is discharged into an exit tray 22.

The developing unit 11 consists of a rotary member including four developing subunits 11A to 11D of Y, M, C and BK, which are disposed equiangularly, viz., at the angular intervals of 90°. In operation, the developing unit 11 is turned to supply color toner onto the surface of the photoreceptor drum 9.

The image transferring drum 12 includes a charging corotron 14, a transferring corotron 15, a retack corotron 16, and a peel-off pawl (not shown). The charging corotron 14 charges a film 12A, so that a paper is electrostatically attracted to the surface of the film 12A of the image transferring drum 12. The transferring corotron 15 transfers a toner image from the photoreceptor drum 9 onto the paper that is electrostatically held on the surface of the film 12A. The retack corotron 16 peels the paper having the image transferred thereto from the image transferring drum 12.

The paper supply section 4 is made up of paper supply cassettes 17A to 17C, feeders 18A to 18C, a manual insertion tray 19, a feeder portion 19A, a preregi roll 23, a preregi pinch roll 24, a regi roll 26, a regi pinch roll 27, and paper bending means 20. The paper supply cassettes 17A to 17C contain stacks of papers of different sizes. The feeders 18A to 18C are provided in association with the paper supply cassettes 17A to 17C, respectively. A command to designate the size of papers to be used is inputted to the machine from an operation panel of the color copying machine. In response to the command, the paper supply cassette is designated, and the feeder portion associated therewith picks up a paper and feeds it forward. A paper to be manually inserted into the machine is put in the manual insertion tray 19. The feeder portion 19A, provided in association with the manual insertion tray 19, picks up the paper and feeds it forward. The preregi roll 23 and the preregi pinch roll 24 cooperate to feed the paper in a state that the leading edge of the paper (including the manually inserted paper) is nipped with the pair of the regi roll 26 and the regi pinch roll 27, whereby the paper is looped. The paired rolls 26 and 27 cooperate to timely feed the paper toward the toner image formed on the photoreceptor drum 9. The paper bending means 20 bends the paper by a preset amount in the same direction as the curving direction of the support surface of the image transferring drum 12.

The color copying machine is provided with an operation panel, not shown. The operation panel contains an input means, such as a key button, for designating the kind of paper used. A copy mode may be selected from among three modes; a thick paper mode (mode A), an envelope mode (mode B), and a normal paper mode (mode C).

Figure 2:
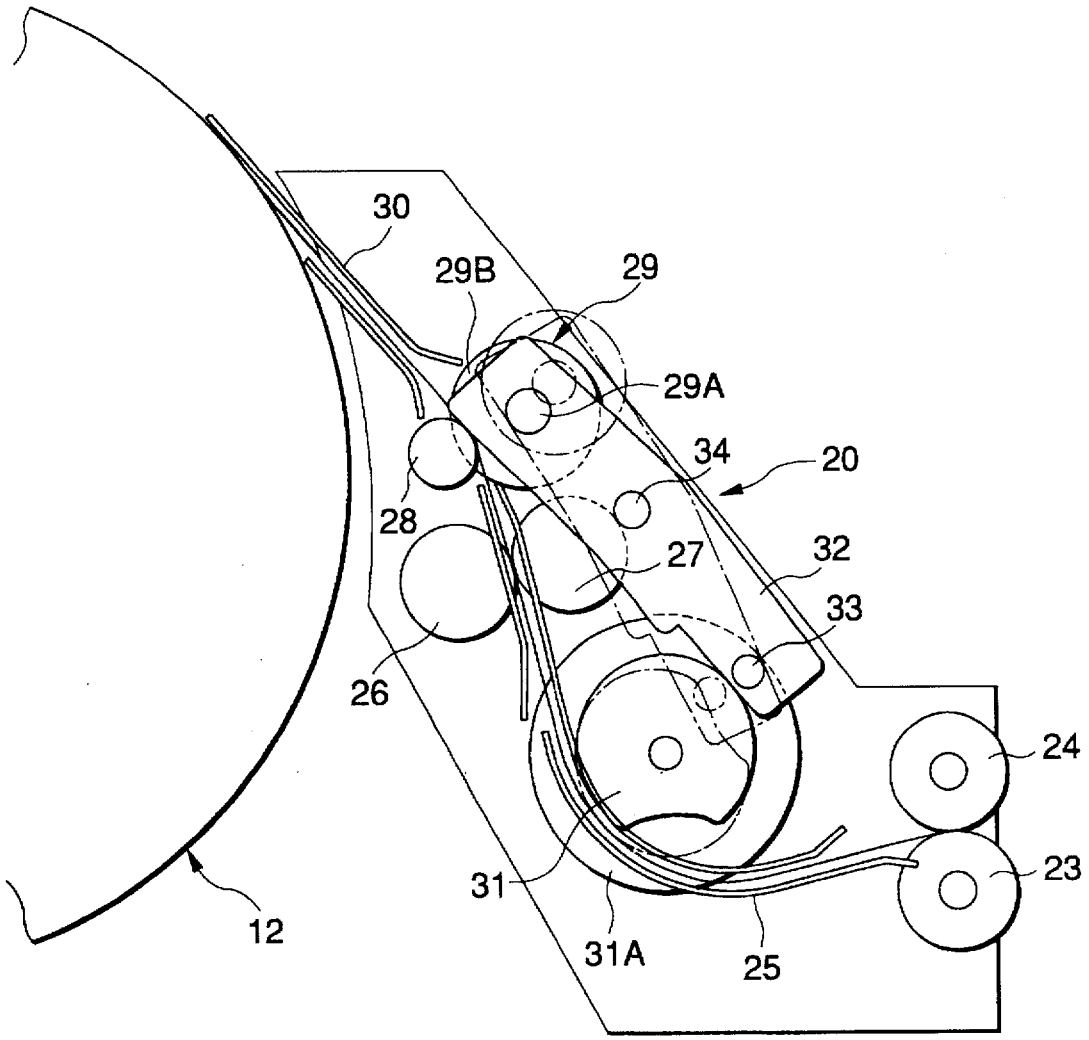
FIG. 2 is an explanatory diagram showing a paper bending means according to an embodiment of the present invention.
Figure 3:
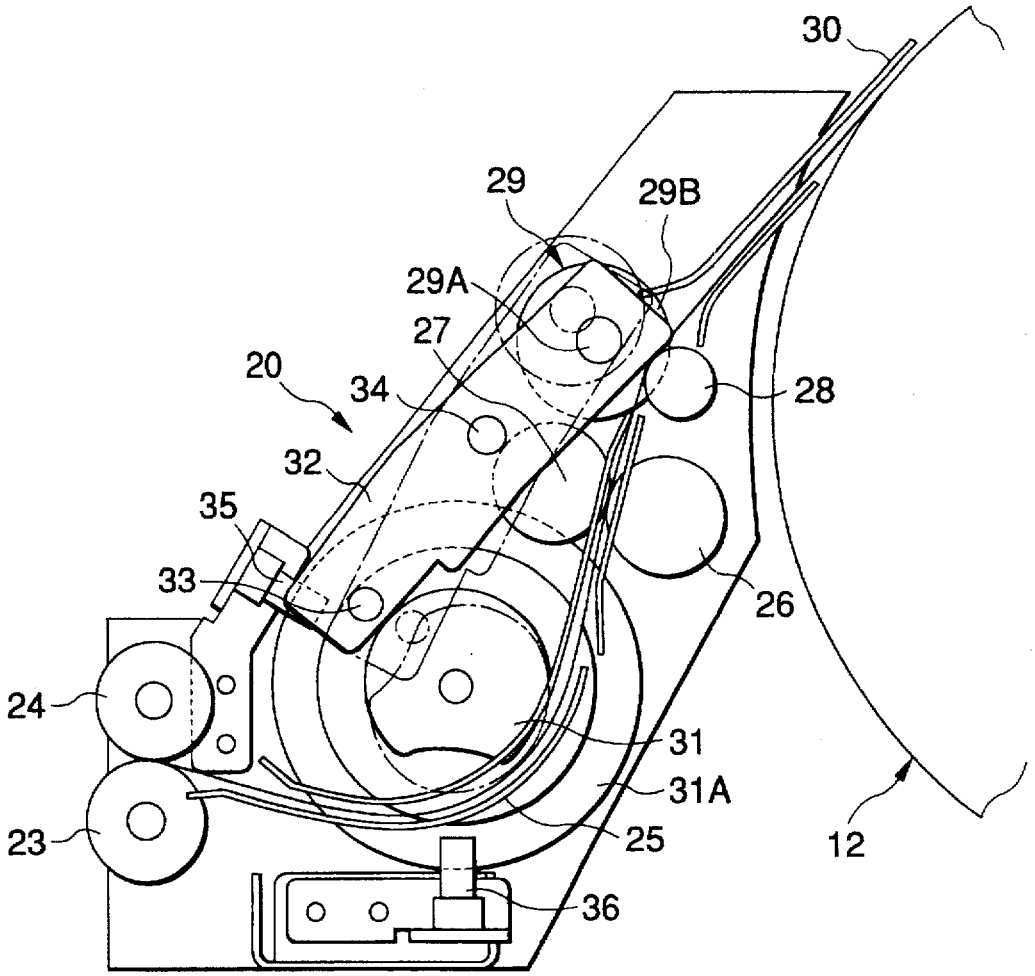
FIG. 3 is a diagram for explaining the paper bending means of the present invention.
Figure 4:
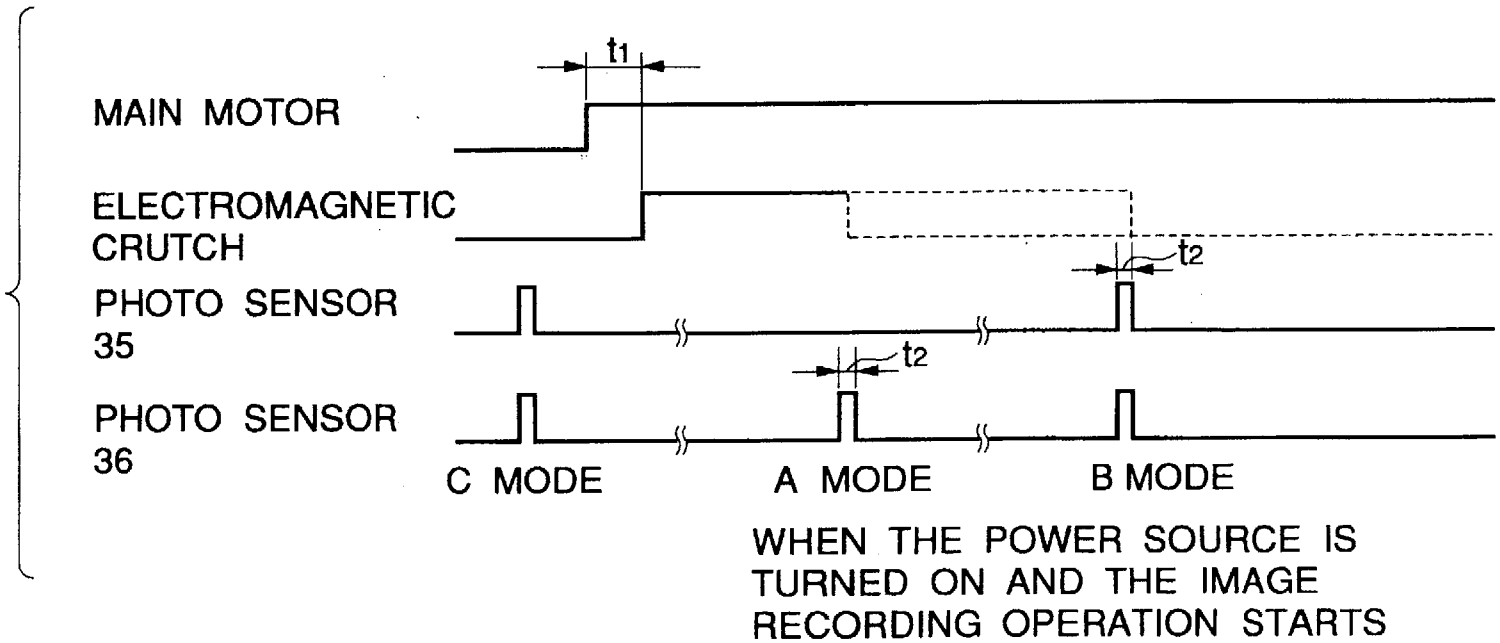
FIG. 4 is a timing chart showing the operation of the image recording apparatus when the power source is turned on and the image recording operation starts.
Figure 5:
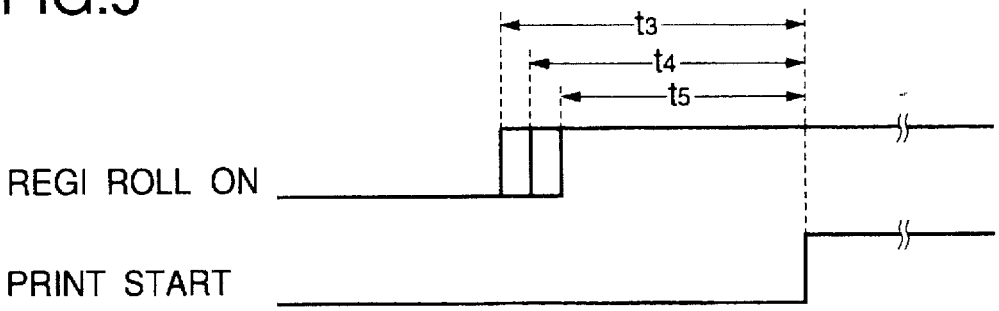
FIG. 5 is a timing chart showing the operation of the image recording apparatus when a paper is supplied.

The construction of a paper transporting path for feeding the paper to the image transferring drum 12 is shown in FIGS. 2 and 3. The transporting path is defined by the pair of the preregi roll 23 and the preregi pinch roll 24, the pair of the regi roll 26 and the regi pinch roll 27, a chute 25 for bending the paper along the curved surface thereof, and a chute 30 for guiding the curved paper to the image transferring drum 12. The paper bending means 20 is installed in this region.

The paper bending means 20 contains a mechanism for bending the paper in the curving direction of the supporting surface of the image transferring drum 12. The bending mechanism includes a curl drive roll 28 and a curl roll 29. The curl drive roll 28 is a metallic roll of 12 mm in diameter, which is driven by a main motor (not shown) to turn. The curl roll 29 is constructed by winding sponge rubber 29B around a metallic shaft 29A of 12 mm in diameter. The hardness of the sponge rubber 29B is 10°. The diameter of the curl roll 29B thus constructed is 26 mm. A drive mechanism to be given later thrusts the curl drive roll 28 into the curl roll 29 to the depth of 2.7 mm in the thick paper mode (mode A), and 3.5 mm in the envelope mode (mode B).

The drive mechanism is composed of a cam 31, a curl lever 32, a detector disc 31A, photo sensors 35 and 36, and a control unit (not shown). The cam 31 is turned when receiving a drive force from a main motor (not shown) through an electromagnetic clutch (not shown). The curl lever 32 supports the metallic shaft 29A of the curl roll 29 by one end thereof, and a pin 33, which is in contact with the circumferential edge of the cam 31, by the other end thereof. When the cam 31 is turned, the curl lever 32 is swung about a fulcrum 34 within a preset range. The detector disc 31A, rotatable with the cam 31, has two cutouts (not shown) angularly spaced 120° and 240° from a reference position. The photo sensors 35 and 36 are located at the positions spaced 120° and 240° from the reference position in the circumferential direction of the detector disc 31A. These photo sensors detect the cutouts of the detector disc 31A, and produce position signals corresponding to three positions 0°, 120° and 240° of the cam 31. The control unit specifies a position of the cam 31 on the basis of a combination of the pulse signals from the photo sensors 35 and 36, and drives the electromagnetic clutch to turn the cam 31 to one position that is selected from three positions in accordance with the kind of the paper that is designated by the input means on the operation panel.

To be more specific, the control unit drives the electromagnetic clutch in accordance with a kind of the paper designated on the operation panel to turn the cam 31. With the turn of the cam 31, the stop position of the cam 31 is shifted at the angular intervals of 120°. When the thick paper mode (mode A) is designated, the cam 31 is turned to a standstill at the position of the mode A. The curl drive roll 28 is thrust into the curl roll 29 to the depth of 2.7 mm. When the envelope paper mode (mode B) is designated, the cam 31 is turned to a standstill at the position of the mode B. The curl drive roll 28 is thrust into the curl roll 29 to the depth of 3.5 mm. The relationships of the copy modes versus the positions signals outputted from the photo sensors 35 and 36 may be tabulated as in Table 1. As seen from Table 1, in the mode A, the photo sensor 35 is coincident in position with one of the cutouts of the detector disc 31A. In the mode B, the photo sensor 36 is coincident in position with the other cutout. In the mode C, the two cutouts of the detector disc 31A are coincident in position with the photo sensors 35 and 36, respectively. As the result of the positional coincidence, the photo sensors 35 and 36 produce "0" and "1", "1" and "0", and "1" and "1". In accordance with the kind of the manually inserted paper designated on the operation panel, the control unit controls the regi roll 26 to vary the time of feeding the paper to the image transferring drum 12.

TABLE 1

| Mode | Print Medium | Photo-sensor 35 | Photo-sensor 36 |
|---|---|---|---|
| Mode A | Thicker paper | 0 | 1 |
| Mode B | Envelope | 1 | 0 |
| Mode C | Normal paper | 1 | 1 |

The operation of the image recording apparatus thus constructed will be described with reference to timing charts of FIGS. 4 to 7.

To start, an operator turns on the power switch. The control unit checks the current copy mode. If the current copy mode is any copy mode other than the normal paper mode (mode C), the control unit drives the main motor and then the electromagnetic clutch, so that a drive force of the main motor is transmitted to the cam 31. The turning of the cam 31 is continued till the signals of "1" and "1" arrive from the photo sensors 35 and 36. And the copy mode is changed to the normal paper mode.

Subsequently, the printing operation in the normal paper mode is performed in a normal printing manner. When the thick paper mode (mode A) or the envelope mode (mode B) is designated, the control unit turns on the electromagnetic clutch to transmit the drive force of the main motor to the cam 31 after time t1(t1=300 ms or longer) elapses from the turn-on of the main motor.

In the thick paper mode (mode A), the drive force of the main motor turns the cam 31, and the photo sensor 36 detects one of the cutouts of the detector disc 31A. When the photo sensor 35 produces a signal of "0" and the photo sensor 36 produces a signal of "1", the control unit turns off the electromagnetic clutch within time t2, to stop the turning of the cam 31. As a result, the curl roll 29 is shifted to the position where the drive roll 28 is thrust into the curl roll 29 to the depth of 2.7 mm.

In the envelope mode (mode B), the drive force of the main motor turns the cam 31, and the photo sensor 36 detects the other cutout of the detector disc 31A. When the photo sensor 35 produces a signal of "1" and the photo sensor 36 produces a signal of "0", the control unit turns off the electromagnetic clutch within time t2, to stop the turning of the cam 31. As a result, the curl roll 29 is shifted to the position where the drive roll 28 is thrust into the curl roll 29 to the depth of 3.5 mm.

Thus, as the result of the swing of the curl lever 32, the curl roll 29 is shifted. One of the feeders 18A to 18C and the feeder portion 19A operates to pick up a paper from its associated paper supply cassette (17A, 17B or 17C) or the manual insertion tray 19, and to feed it forward. The paper is then nipped with the pair of the preregi roll 23 and the preregi pinch roll 24. With the turn of the rolls 23 and 24, the paper is led to the pair of the regi roll 26 and the regi pinch roll 27 while being guided by the chute 25. The paper is curled before the roll pair, thereby to correct a skew of the paper.

The control unit turns the regi roll 26 at the timing specified by a copy mode specified on the operation panel. In the thick paper mode (mode A), the control unit causes the regi roll 26 to start its operation at time t4 earlier than in the normal paper mode (mode C). In the envelope mode (mode B), the control unit causes the regi roll 26 to start its operation at time t3 earlier than in the thick paper mode (mode A).

The paper is fed forward by the pair of the regi roll 26 and the regi pinch roll 27, and led to the pair of the curl drive roll 28 and the curl roll 29 of which the thrust is set at 2.7 mm in the thick paper mode (mode A), and at 3.5 mm in the envelope mode (mode B). The sponge rubber 29B of the curl roll 29 presses the paper against the curl drive roll 28, so that the paper is plastically deformed at the curvature of the outer surface of the curl drive roll 28 of 12 mm in diameter.

A curvature of the plastically deformed paper is 1/100 to 1/200 in the thick paper mode (mode A) since the thrust is 2.7 mm. The curvature is smaller than the radius of curvature of the image transferring drum 12, which is 1/84. In the envelope mode (mode B), the curvature of the deformed paper is 1/130 to 1/230 since the thrust is 3.5 mm, and is smaller than the radius of curvature of the image transferring drum 12.

The paper thus plastically deformed is led to the image transferring drum 12 while being guided by the chute 30. As a result, the paper is electrostatically attracted onto the image transferring drum 12 by the charging corotron 14. At this time, the potential at the charging corotron 14 is set to be equal to the potential of the transferring corotron 15 so that the paper is exactly supported on the image transferring drum 12 and the transferring operation of no toner image is performed. When the trailing edge of the paper leaves the nip between the pair of the curl drive roll 28 and the curl roll 29, the force which the paired rolls 28 and 29 have applied to the paper disappears, to thereby eliminate an influence of the image transferring drum 12 upon the irregular rotation. Further, the potential of the transferring corotron 15 may be selected independently of the parameters of the potential in the subsequent recording process of the colors Y, M, C and BK. For this reason, it is possible to increase the attraction force of the image transferring drum 12 when it attracts the paper. This is one of the advantageous features of the present embodiment.

The photoreceptor drum 9 is subjected to an exposure process in the image writing unit 7. Specifically, it is exposed to the light containing the image data gathered in the image input section 2, so that an electrostatic latent image is formed on the surface of the photoreceptor drum 9 in accordance with the image data. The latent image on the photoreceptor drum 9 receives color toner in the developing unit 11. The paper that has been attracted onto the surface of the image transferring drum 12 receives the toner image from the photoreceptor drum 9. The transferring operation of a color image onto the paper is completed when it is turned four times. The paper having the color image is peeled off from the image transferring drum 12 by the retack corotron 16. The color image is fixed on the paper by the fixing unit 21. The paper having the fixed color image is discharged into the exit tray 22.

Figure 6:
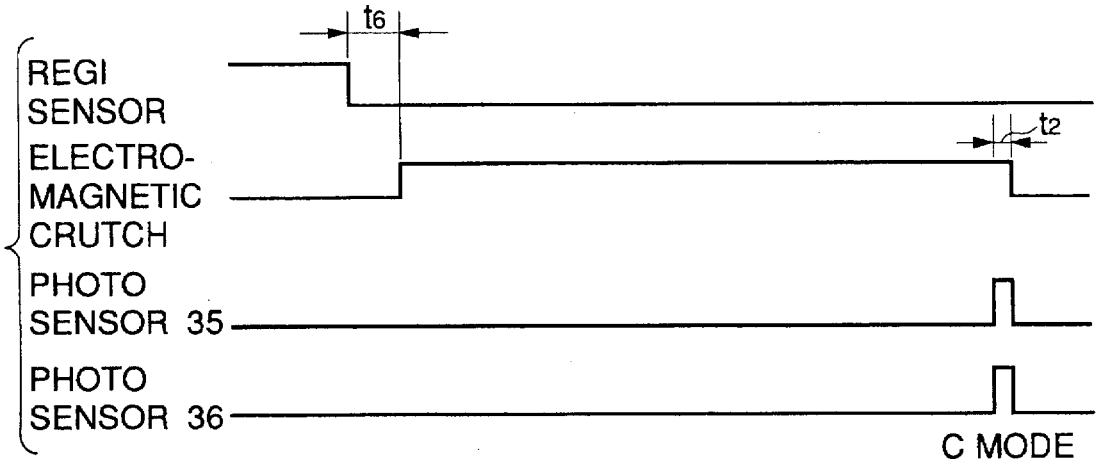
FIG. 6 is a timing chart showing the operation of the image recording apparatus when the thick paper mode or the envelope mode ends.

When the image copying operation is completed in the thick paper mode (mode A) or the envelope mode (mode B), the copy mode is switched to the normal paper mode (mode C) in accordance with a timing chart shown in FIG. 6. When a regi sensor (not shown) for sensing the paper is turned off, the control unit is turned off and after time $t_6$ elapses, the electromagnetic clutch is turned on. A drive force of the main motor is transferred to the cam 31. In turn, the cam 21 turns. With the turn of the cam 31, the photo sensors 35 and 36 are turned to sense the cutouts of the detector disc 31A, and produce signals of "1" and fill. Within time $t_2$, the control unit turns off the electromagnetic clutch to stop the turn of the cam 31. At this time, the curl lever 32 is swung and hence the curl roll 29 is shifted to the position furthest from the curl drive roll 28. The degree of the bending of the paper is set to the least value of the bending degree.

Figure 7:
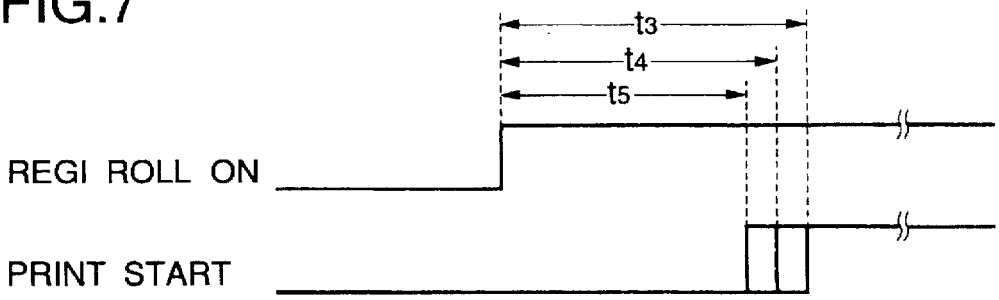
FIG. 7 is a timing chart showing the operation of the image recording apparatus when a paper is supplied.

In the above-mentioned embodiment, the input means, such as a key button, is used for specifying the kind of the copy paper, for example. A sensing signal of the thick paper sensor, the size of the image recording medium, the vertical or lateral feeding of the paper or the like may be used for the same purpose, as a matter of course. The copy mode (kind of the paper) is used for controlling the time of starting the regi roll 26, viz., the time to supply the paper to the image transferring drum. In an alternative, as shown in FIG. 7, the time of starting the image recording operation is varied within the period of time $t_3$ to $t_5$, while the time of supplying the paper to the image transferring drum in each copy mode is fixed.

Figure 8:
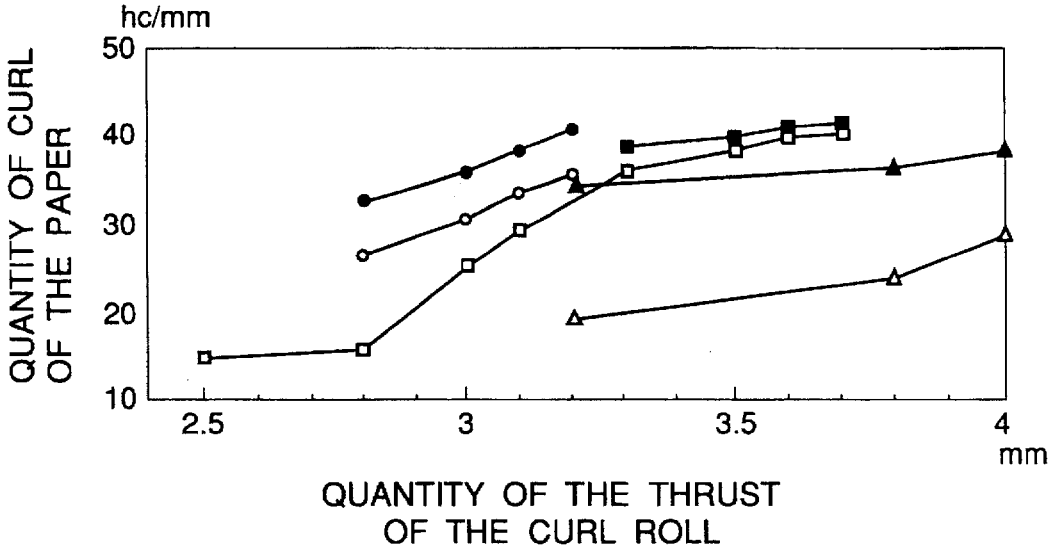
FIG. 8 is a graph showing a relationship between a quantity of curl of the paper and a quantity of the thrust of the curl roll.
Figure 9:
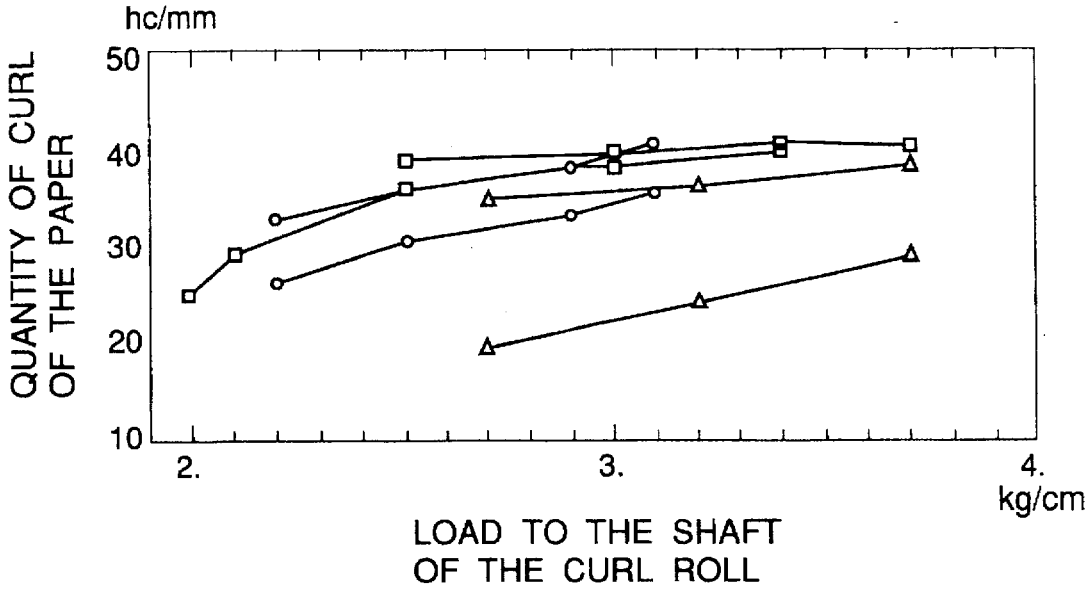
FIG. 9 is a graph showing a relationship between a quantity of curl of the paper and a load to the shaft of the curl roll.
Figure 10:
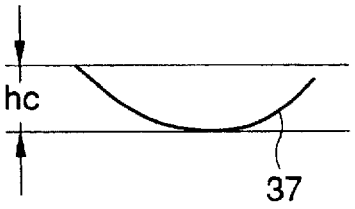
FIG. 10 is a diagram for explaining a measurement of a quantity of curl of a post card.

In FIGS. 8 and 9, graphs show a variation of a quantity of curl of a postal card with respect to a quantity of the roller thrust, and a variation of the curl quantity with respect to a load to the curl roll shaft. In the graphs, parameters are the outside diameter of the curl roll, the diameter of the curl roll shaft, and the running condition of the postal card. In each graph, six combinations of those parameters are used. The curl quantity hc of the postal card, plotted along the ordinate of the graph, was measured by a measuring method shown in FIG. 10 (a postal card is designated by reference numeral 37).

As seen from FIGS. 8 and 9, the curl quantity of the postal card is substantially proportional to the roller thrust quantity, and the load to the roll shaft. Then, when the latter increases, the former also increases. The best curl quantity hc of the postal card is within the range from approximately 15 to 20 mm when it is supported on the image transferring drum. Therefore, the outside diameter of the curl roll, the diameter of the curl roll shaft, the running condition of the postal card, the roller thrust quantity, and the load to the roll shaft are selected so as to have such the best curl quantity hc.

As seen from the foregoing description, the image recording apparatus of the present invention is constructed such that a degree of the bending of a paper by paper bending means is varied to a preset value in accordance with the kind of an image recording medium that is entered from recording medium input means. With such a construction, any kind of the image recording medium can securely be supported on the image transferring drum. If the time of supplying the image recording medium to the bending means or the time of starting the image recording operation is controlled in accordance with a degree of the paper bending set by bending degree setting means, the image recording alignment performance may be improved.

What is claimed is:

1. An image recording apparatus using an image transfer system which transfers a toner image onto an image recording medium being supported on an image transferring drum, comprising:

a medium transporting path for transporting the image recording medium onto the image transferring drum;

medium bending means, provided in said medium transporting path, for bending the image recording medium along the curved supporting surface of the image transferring drum;

bending condition setting means for setting the conditions for bending the image recording medium by said medium bending means on the basis of a kind of the image recording medium;

timed medium-supplying means for supplying the image recording medium to the image transferring drum at the time of transferring a toner image onto the image recording medium; and time/condition setting means for setting the time of supplying the image recording medium to the image transferring drum by said timed medium-supplying means on the basis of a thickness of the image recording medium or on the basis of the conditions for bending the image recording medium set by said bending condition setting means.

2. The image recording apparatus of claim 1, wherein said medium bending means comprises a rigid roll having a rotational axis that may be turned about its rotational axis, and a deformable roll having a rotational axis that may be turned about its rotational axis, when the outer surface of said rigid roll is pressed against the outer surface of said deformable roll, the outer surface of said deformable roll being deformable; and said bending condition setting means varies a distance between the rotational axes of the rigid roll and the deformable roll on the basis of a kind of the image recording medium.

3. The image recording apparatus of claim 2, wherein said time/condition setting means sets said timed medium-supplying means so as to supply the image recording medium to said image transferring drum earlier as the distance between said [first and second shafts] rotational axes of the rigid roll and the deformable roll that is set by said bending condition setting means becomes shorter.

4. The image recording apparatus of claim 1, wherein said time/condition setting means sets said timed medium-supplying means so as to supply the image recording medium to said image transferring drum earlier as the image recording medium is thicker.

5. The image recording apparatus of claim 1, wherein the kind of the image recording medium is discriminated as an envelope or a normal paper.

6. The image recording apparatus of claim 5, wherein said time/condition setting means sets said timed medium-supplying means so as to earlier supply a normal paper to said image transferring drum than to supply an envelope thereto.

7. An image recording apparatus using an image transfer system which transfers a toner image onto an image recording medium being supported on an image transferring drum, comprising:

a medium transporting path for transporting the image recording medium onto said image transferring drum;

medium bending means, provided in said medium transporting path, for bending the image recording medium along the curved supporting surface of said image transferring drum;

bending condition setting means for setting the conditions for bending the image recording medium by said medium bending means on the basis of a kind of the image recording medium; and control means for controlling the time of writing a toner image onto said image transferring drum on the basis of a thickness of the image recording medium or on the basis of the conditions for bending the image recording medium.

8. The image recording apparatus of claim 7, wherein said medium bending means comprises a rigid roll having a rotational axis that may be turned about its rotational axis, and a deformable roll having a rotational axis that may be turned about its rotational axis, when the outer surface of said rigid roll is pressed against the outer surface of said deformable roll, the outer surface of said deformable roll being deformable, and said bending condition setting means varies a distance between said rotational axes of the rigid roll and the deformable roll on the basis of a kind of the image recording medium.

9. The image recording apparatus of claim 8, wherein said control means retards the writing of the toner image onto said image transferring drum as the distance between said rotational axes of the rigid roll and the deformable roll that is set by said bending condition setting means becomes shorter.

10. The image recording apparatus of claim 7, wherein said control means retards the writing of the toner image onto said image transferring drum as the image recording medium is thicker.

11. The image recording apparatus of claim 7, wherein the kind of the image recording medium is discriminated as an envelope or a normal paper.

12. The image recording apparatus of claim 11 wherein said control means more retards the writing of the toner image onto an envelope supported on said image transferring drum than onto a normal paper supported thereon.

* * * * *